US012031325B2

(12) United States Patent
Wheeler

(10) Patent No.: US 12,031,325 B2
(45) Date of Patent: Jul. 9, 2024

(54) WALL FRAMING FOR VERTICAL DEFLECTION

(71) Applicant: FlexAbility Concepts, LLC, Oklahoma City, OK (US)

(72) Inventor: Frank Wheeler, Oklahoma City, OK (US)

( * ) Notice: Subject to any disclaimer, the term of this patent is extended or adjusted under 35 U.S.C. 154(b) by 0 days.

(21) Appl. No.: 17/892,922

(22) Filed: Aug. 22, 2022

(65) Prior Publication Data

US 2023/0056349 A1 Feb. 23, 2023

Related U.S. Application Data

(60) Provisional application No. 63/235,301, filed on Aug. 20, 2021.

(51) Int. Cl.

| | |
|---|---|
| ***E04B 2/74*** | (2006.01) |
| ***E04B 1/98*** | (2006.01) |
| ***E04B 2/58*** | (2006.01) |
| ***E04C 3/00*** | (2006.01) |
| ***E04C 3/32*** | (2006.01) |
| *E04C 3/04* | (2006.01) |

(52) U.S. Cl.

CPC ..... *E04B 2/7457* (2013.01); *E04B 1/98* (2013.01); *E04B 2/58* (2013.01); *E04C 3/005* (2013.01); *E04C 3/32* (2013.01); *E04B 2002/7481* (2013.01); *E04C 2003/0473* (2013.01)

(58) Field of Classification Search

CPC . E04B 1/98; E04B 2/58; E04B 2/7457; E04B 2002/7481; E04C 3/005; E04C 3/32; E04C 2003/0473

See application file for complete search history.

(56) References Cited

U.S. PATENT DOCUMENTS 5,291,717 A * 3/1994 Turner ..... E04B 2/7457 52/631
5,553,961 A * 9/1996 Olden ..... E04C 3/005 403/DIG. 15
6,000,181 A * 12/1999 Wheeler ..... E04B 2/82 52/745.09
6,237,301 B1 * 5/2001 Paradis ..... E04C 3/005 52/717.06

(Continued)

FOREIGN PATENT DOCUMENTS

CA 2656542 A1 * 1/2008 ..... E04B 9/06
EP 0644003 A2 * 3/1995

(Continued)

*Primary Examiner* — Jessie T Fonseca

(57) ABSTRACT

A structure and associated methodology for framing a wall having top and bottom runners supporting respective opposing ends of each of a plurality of upright studs. The top runner has a planar base and a track extending from the base and forming therewith an enclosure configured to operably capture top ends of the studs and compensate for vertical deflection. The track defines a laterally-directed slot configured for installing a fastener through to connect to the stud inside the enclosure. The track further defines indicia visually presenting a conformance-comparison of each stud's length to a predetermined threshold before the fastener is installed, the threshold related to a predetermined operable clearance between each stud's end and the base inside the enclosure.

20 Claims, 14 Drawing Sheets

(56) References Cited

U.S. PATENT DOCUMENTS 6,434,908 B1 * 8/2002 Ferrante ..... E04C 3/07 52/669
6,637,173 B1 * 10/2003 Wheeler ..... E04B 2/7457 52/745.12
6,655,100 B1 * 12/2003 Andino ..... E04B 2/7457 52/717.06
7,073,299 B1 * 7/2006 diGirolamo ..... E04B 2/7453 52/745.11
7,293,392 B2 * 11/2007 Krumbacher ..... E04B 2/7457 52/246
7,458,188 B2 * 12/2008 Mears ..... E04C 3/09 52/245
7,941,983 B2 * 5/2011 Wheeler ..... E04B 9/06 52/223.9
8,276,335 B2 * 10/2012 Waibel ..... E04B 2/82 52/846
8,453,403 B2 * 6/2013 Wheeler ..... E04C 3/40 52/246
2005/0086896 A1 * 4/2005 Krumbacher ..... E04B 2/7457 52/633
2005/0086902 A1 * 4/2005 Mears ..... E04B 9/061 52/749.1
2005/0115192 A1 * 6/2005 Stone ..... E04C 3/07 52/85
2006/0277841 A1 * 12/2006 Majusiak ..... E04B 2/767 52/241
2008/0115427 A1 * 5/2008 Wheeler ..... E04C 3/005 52/745.19
2009/0077923 A1 * 3/2009 Mears ..... E04B 9/061 52/708
2009/0178363 A1 * 7/2009 Pilz ..... E04C 3/09 52/846
2013/0031856 A1 * 2/2013 Pilz ..... E04B 1/941 52/232
2013/0104474 A1 * 5/2013 Klein ..... E04C 2/36 52/232
2014/0130436 A1 * 5/2014 Gulbrandsen ..... E04B 9/061 52/506.07
2017/0037619 A1 * 2/2017 Dietzen ..... E04C 3/11

FOREIGN PATENT DOCUMENTS

EP 2998456 A1 * 3/2016 ..... E04C 3/005
WO WO-9921669 A1 * 5/1999 ..... B21D 47/01
WO WO-9955977 A1 * 11/1999 ..... E04B 2/7457
WO WO-0218723 A1 * 3/2002 ..... E04B 2/7457
WO WO-03097956 A1 * 11/2003 ..... E04B 2/7457
WO WO-2021003431 A1 * 1/2021 ..... E04B 1/54

* cited by examiner

WALL FRAMING FOR VERTICAL DEFLECTION

RELATED APPLICATION

The present application makes a claim of domestic priority under 35 U.S.C. 119(e) to U.S. Provisional Patent Application No. 63/235,301 filed Aug. 20, 2021, the contents of which being hereby incorporated by reference.

BACKGROUND

Initially, this disclosure is by way of example only, not by limitation. The illustrative constructions and associated methods disclosed herein are not limited to use or application in any specific system or environment. That is, this disclosure is not limited to upright framing members of a runner-and-stud wall as is disclosed in the illustrative embodiments. Thus, although the instrumentalities described herein are for the convenience of explanation, shown and described with respect to exemplary embodiments, the skilled artisan understands that the inventive principles disclosed herein are equally applicable to other types of structural framing systems and environments.

It has become more prevalent that structural framing components for walls and ceilings, particularly in commercial construction, are nowadays made of metal instead of traditionally being made of wood. Metal structural framing for constructing a wall can generally consist of a number of upright metal studs, each individually attached at opposing ends to top and bottom metal tracks, or runners. The bottom runner is supported upon a foundation such a floor, and the top runner is supported by an overhead structure. Such structural framing of this invention can be configured to include straight wall portions, curvilinear wall portions, and combinations of and transitions between straight wall portions and curvilinear wall portions.

The claimed invention more particularly relates to structural framing configured to free up the top runner 106 so that it can deflect vertically in response to stresses that are translated to the top runner 106. The stresses can be ordinary environmental loads such as wind and snow loads, traffic loads, and the like, for example. They translate downwardly-directed stresses against the top runner 106. By giving the top runner 106 limited freedom of movement to reposition downwardly relative the stationary studs 110, that advantageously results in relieving these stresses without further translating them to the studs 110. Wall coverings can be selectively attached, such as only to the studs to prevent distortions during vertical deflection.

SUMMARY

Some embodiments of this invention contemplate a structural framework configured for constructing a curvilinear wall. The structural framework has top and bottom runners supporting respective opposing ends of each of a plurality of upright studs. The top runner has a plurality of sections pivotally joined together and thereby configured to form a wall having a selected curvature. Each section has a planar base, and a track extending from the base and forming therewith an enclosure configured to receivingly engage the top ends of the studs. The track supports a flange defining a longitudinally-directed channel, a longitudinally-directed protuberant strap, and a laterally-directed slot configured for passing a fastener through to connect to one of the studs. The pivotal connection of adjacent first and second sections slidingly engages the first section's protuberant strap in the second section's channel.

Some embodiments of this invention contemplate a structural framework for framing a curvilinear wall, having top and bottom runners supporting respective opposing ends of each of a plurality of upright studs. The top runner has a plurality of sections pivotally joined together to form a selected curvature. Each section includes a planar base, and a track extending from the base and forming therewith an enclosure configured to receivingly engage each stud's top end. The track supports a flange defining a longitudinally-directed channel and a laterally-directed slot configured for passing a fastener to connect the section to a selected one of the studs. A strap passes through the longitudinally-directed channel, wherein the pivotal connection of adjacent first and second sections slidingly engages the flange along the strap.

Some embodiments of this invention contemplate a structure for framing a wall having top and bottom runners supporting respective opposing ends of each of a plurality of upright studs. The top runner has a planar base and a track extending from the base and forming therewith an enclosure configured to operably capture top ends of the studs and compensate for vertical deflection. The track defines a laterally-directed slot configured for installing a fastener through to connect to the stud inside the enclosure. The track further defines indicia visually presenting a conformance-comparison of each stud's length to a predetermined threshold before the fastener is installed, the threshold related to a predetermined operable clearance between each stud's end and the base inside the enclosure.

DRAWINGS

Figure 3:
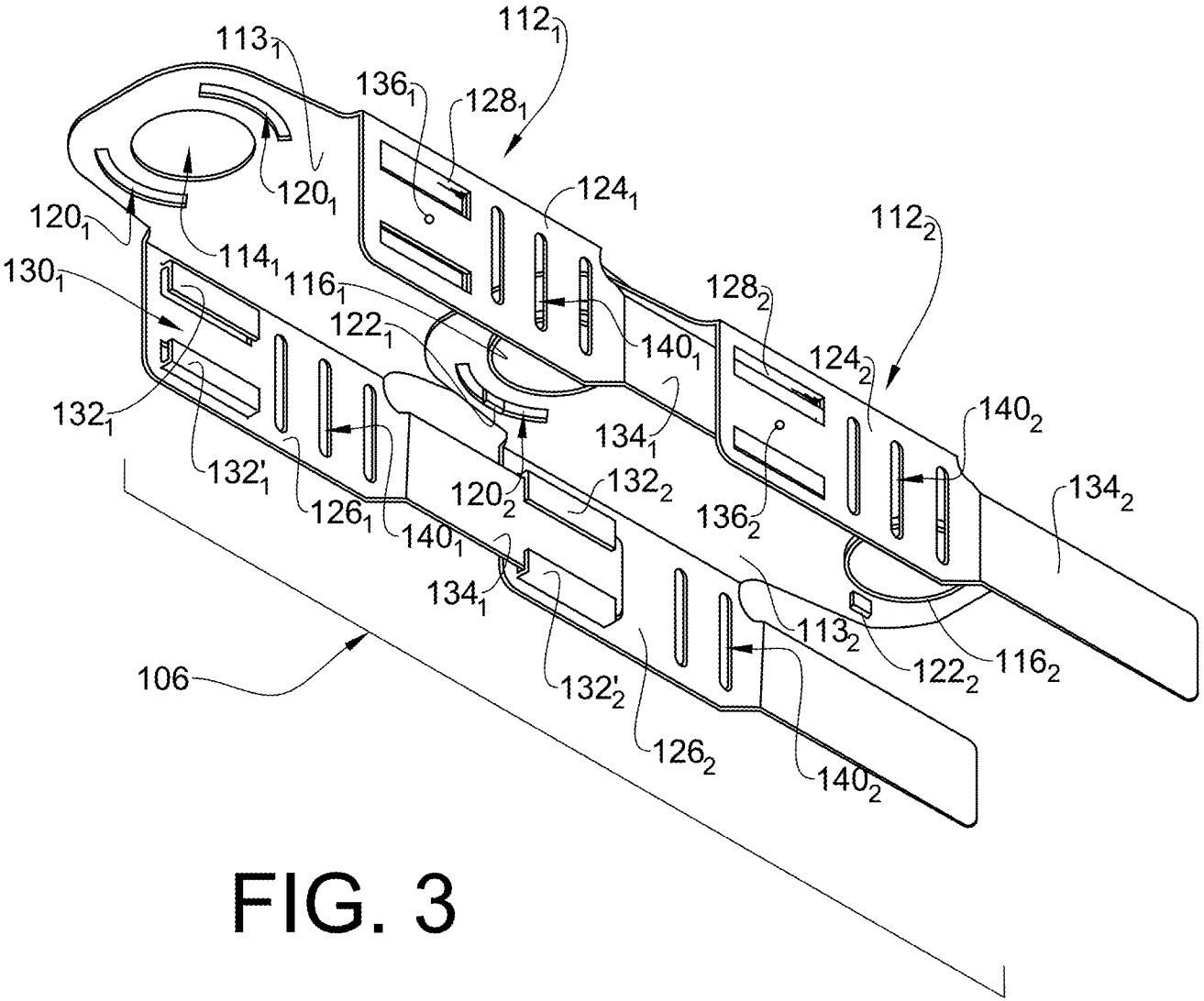
FIG. 3 depicts an enlarged isometric view of the two adjacent sections that are pivotally joined together to form part of the top runner in the structural framework in FIG. 2, consistent with illustrative embodiments.
Figure 5A:
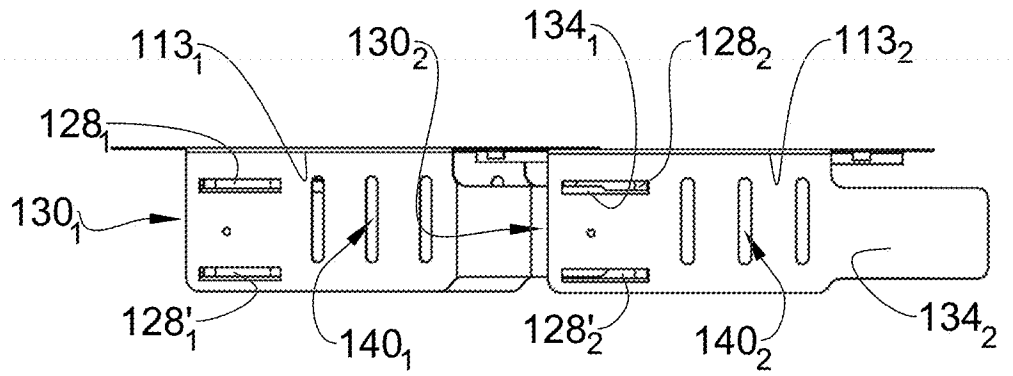
Figure 5B:
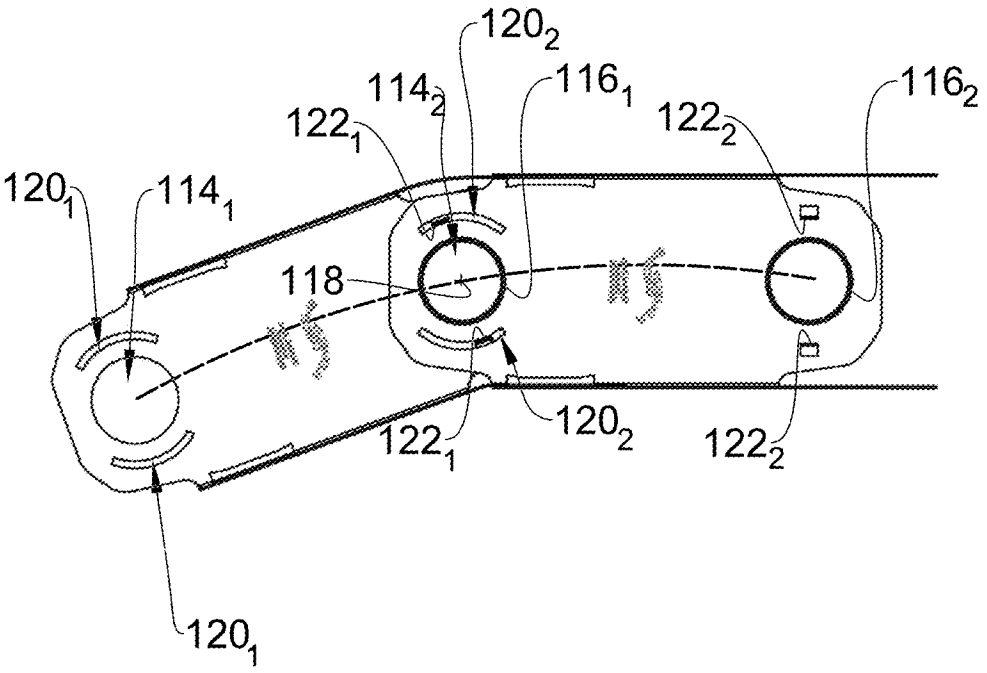

FIG. 5*a* depicts a side view and FIG. 5*b* depicts a bottom view of the adjacent sections in FIG. 3, consistent with illustrative embodiments.

Figure 2:
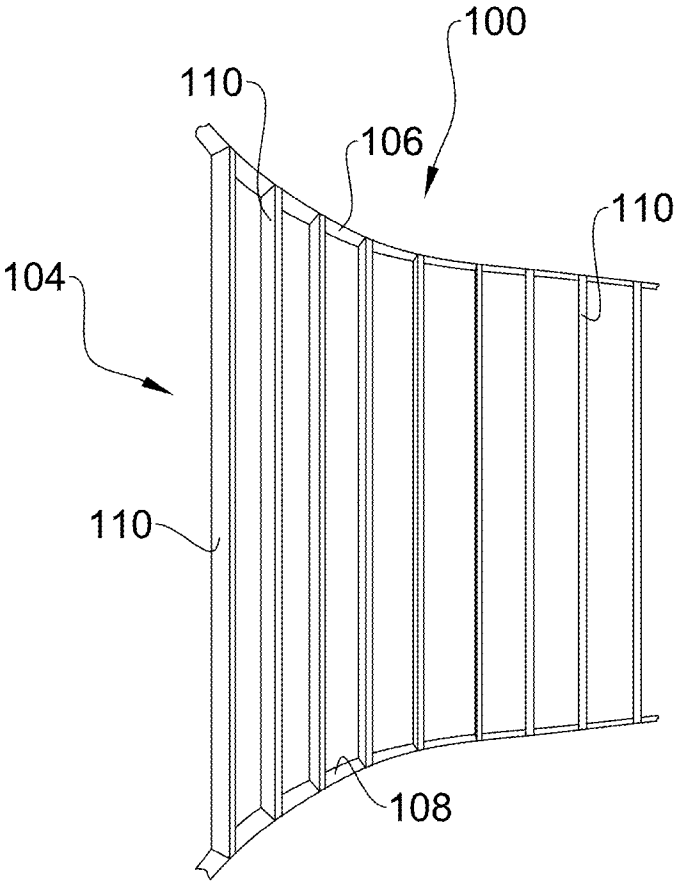
FIG. 2 depicts an enlarged view of a curvilinear wall portion in FIG. 1 but with the wall covering materials removed from both sides of the wall and thereby revealing the underlying structural framework, consistent with illustrative embodiments.
Figure 6:
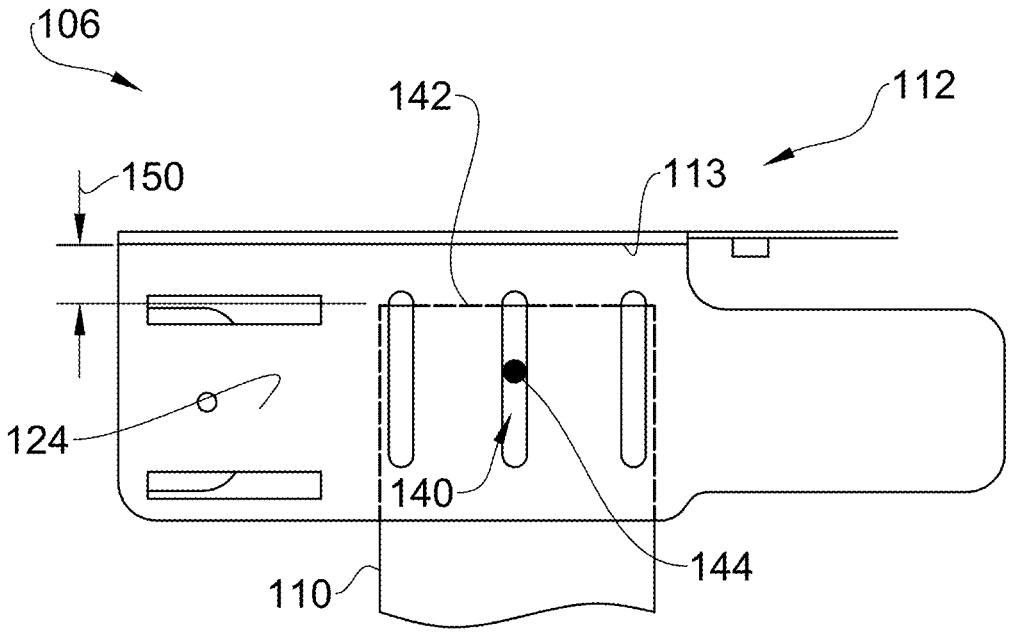

FIG. 6 depicts a connection of a stud to a top runner in the underlying structural framework depicted in FIG. 2, consistent with illustrative embodiments.

Figure 7:
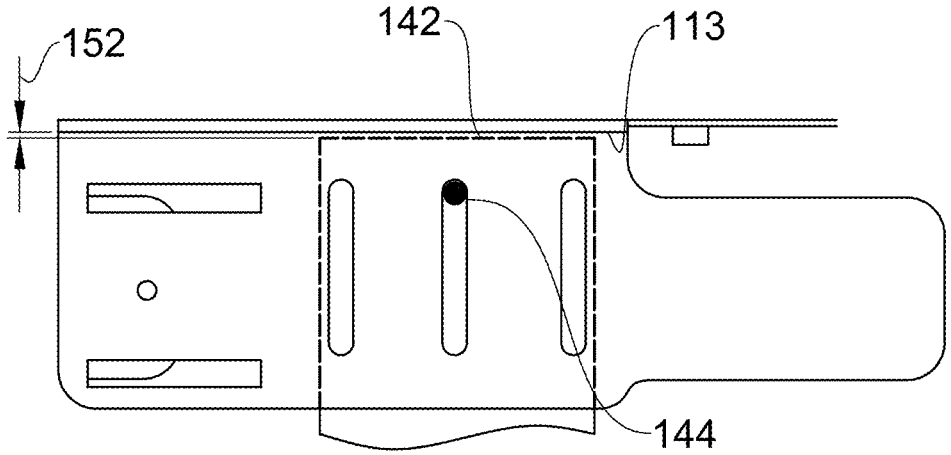

FIG. 7 is similar to FIG. 6 but depicting a vertical deflection from downward stresses translated to the top runner, consistent with illustrative embodiments.

Figure 8A:
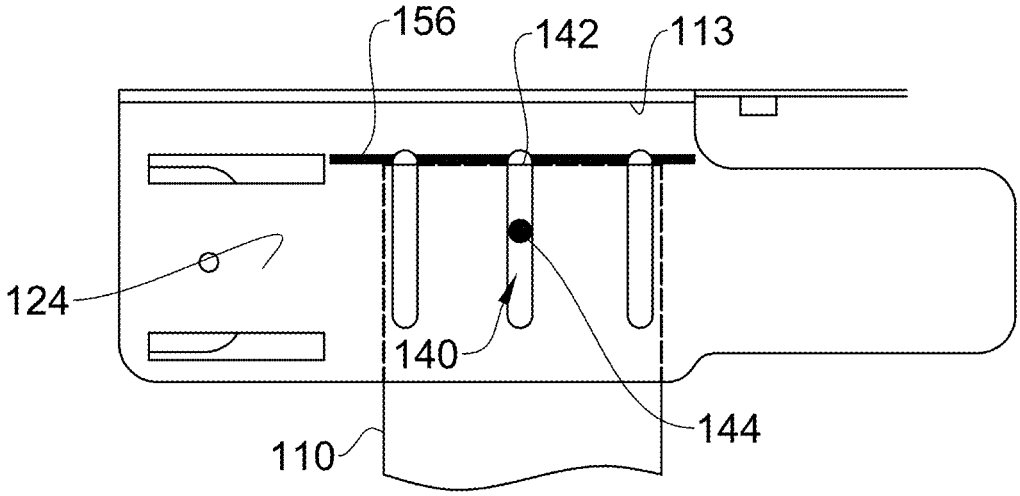
Figure 8B:
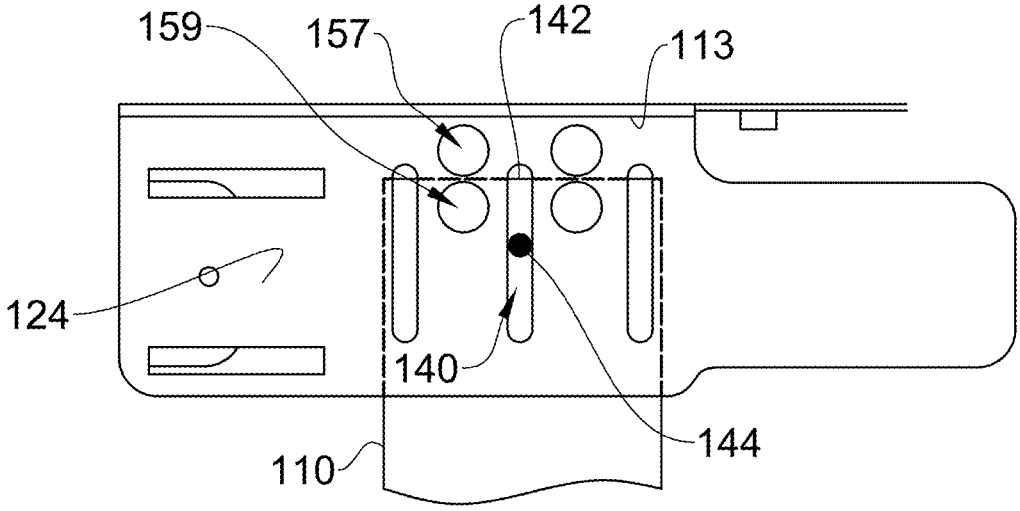
Figure 8C:
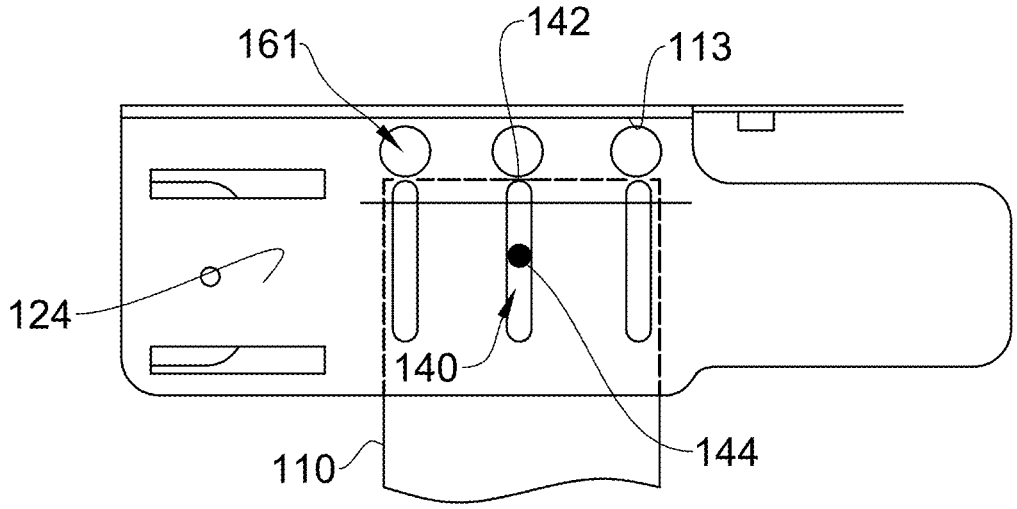

FIG. 8*a* is similar to FIG. 6 but also depicting an indicia configured to visually display a comparison of the next stud's length to a predetermined threshold length for determining whether the stud's length conforms to requirements for accommodating the full expected range of vertical deflection. FIGS. 8*b* and 8*c* depict alternative indicia that are likewise configured to visually display the comparisons of actual stud lengths to the predetermined conformance threshold, consistent with illustrative embodiments.

Figure 9A:
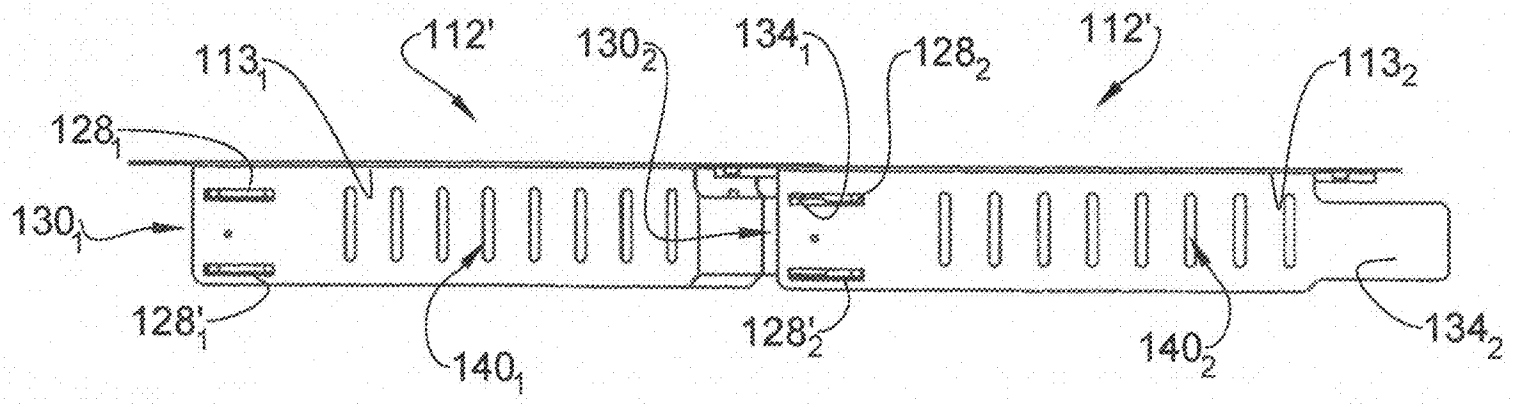
Figure 9B:
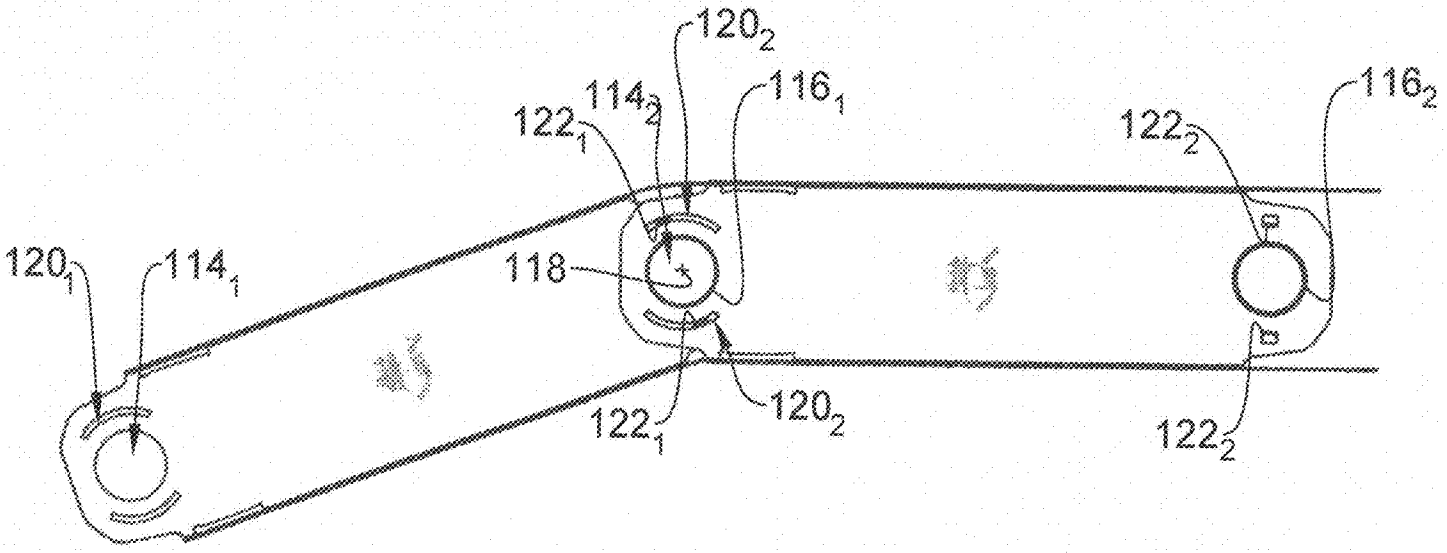

FIGS. 9*a* and 9*b* are similar to FIGS. 5*a* and 5*b* but depicting alternative embodiments having longer sections.

Figure 10:
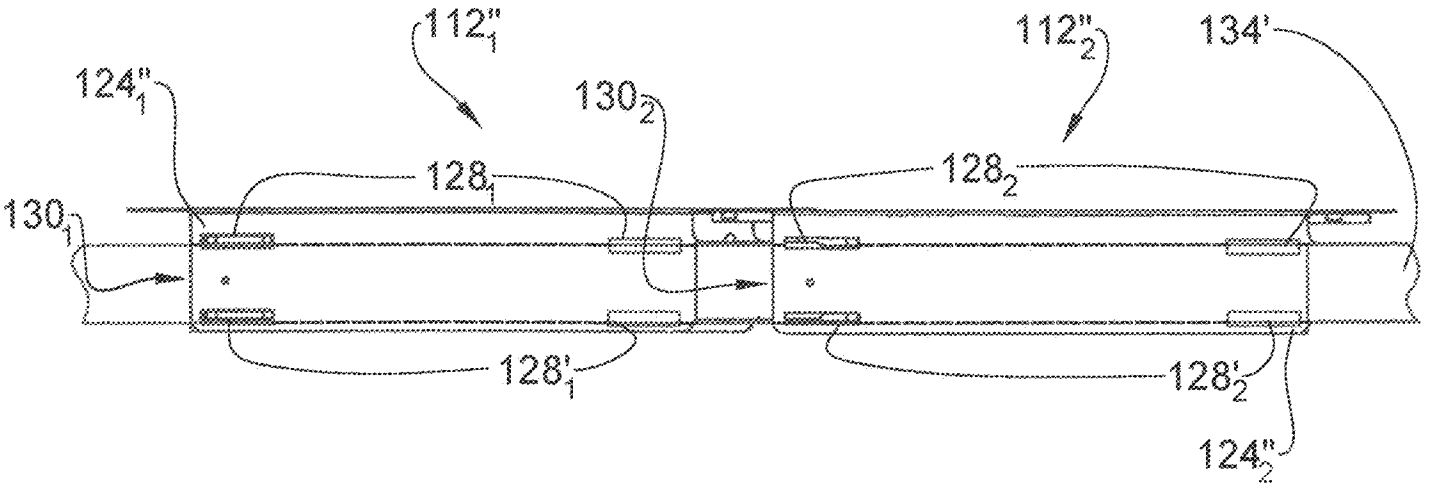

FIG. 10 is a modified version of FIG. 9 that replaces each section's individual protuberant strap with a discrete continuous strap connecting two or more adjacent sections of the top runner together, consistent with illustrative embodiments.

Figure 11:
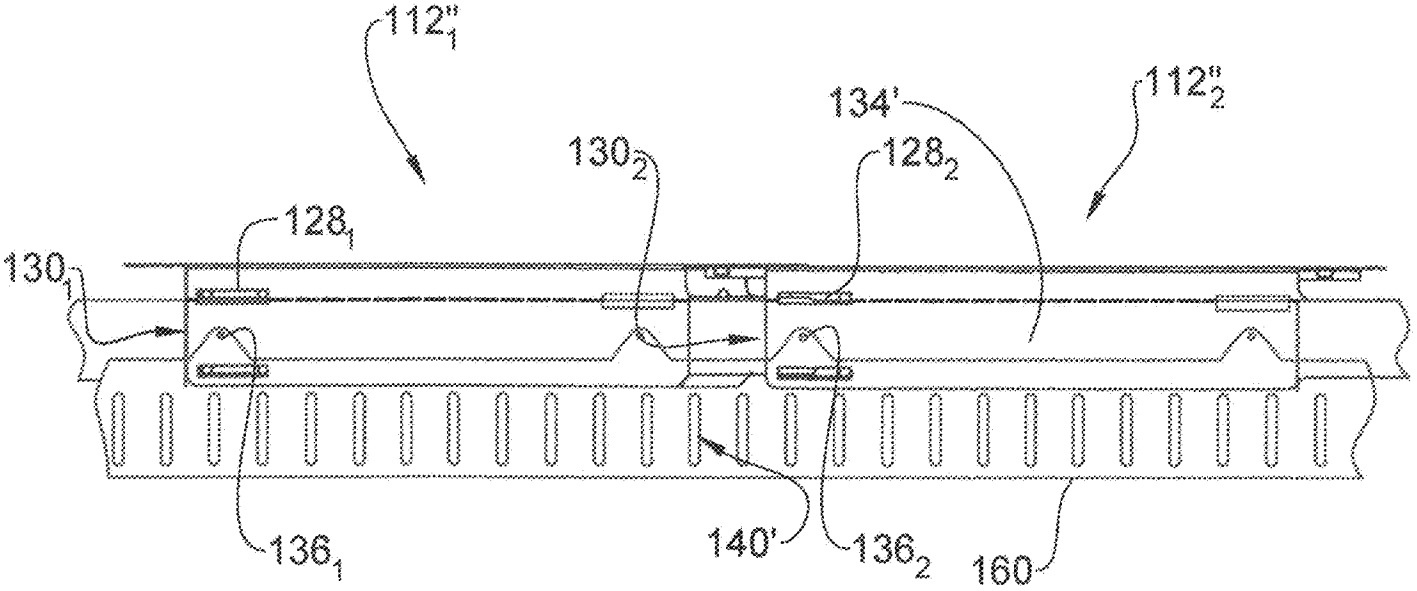

FIG. 11 depicts a vertical deflection member attached to and spanning two or more adjacent sections of the top runner of FIG. 10, consistent with illustrative embodiments.

Figure 12:
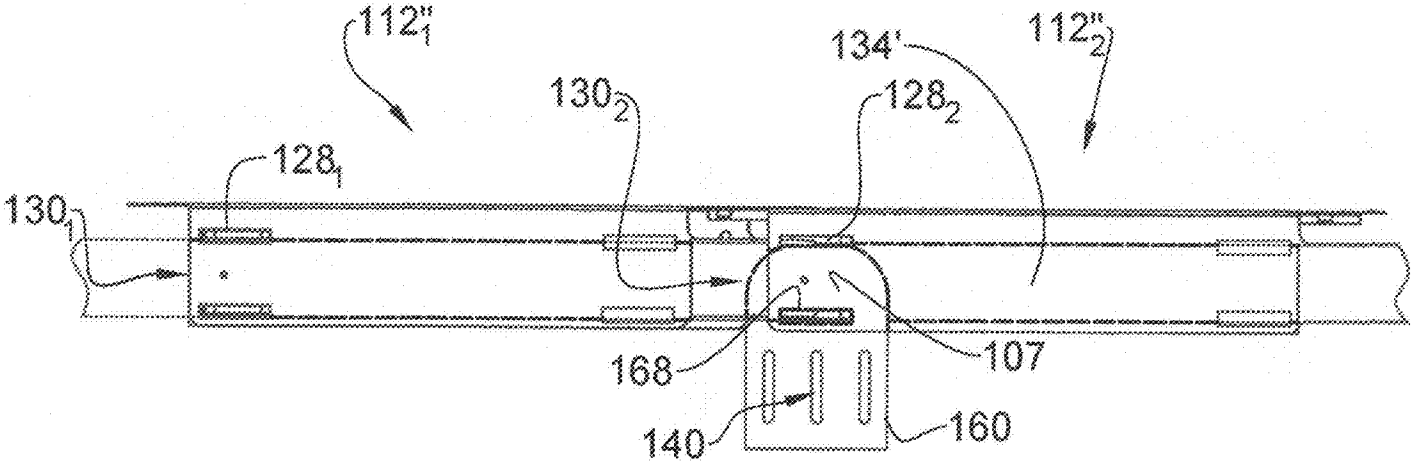

FIG. 12 depicts an alternative deflection member attached to only one of the sections of the top runner, consistent with illustrative embodiments.

DESCRIPTION OF EXEMPLARY EMBODIMENTS

Figure 1:
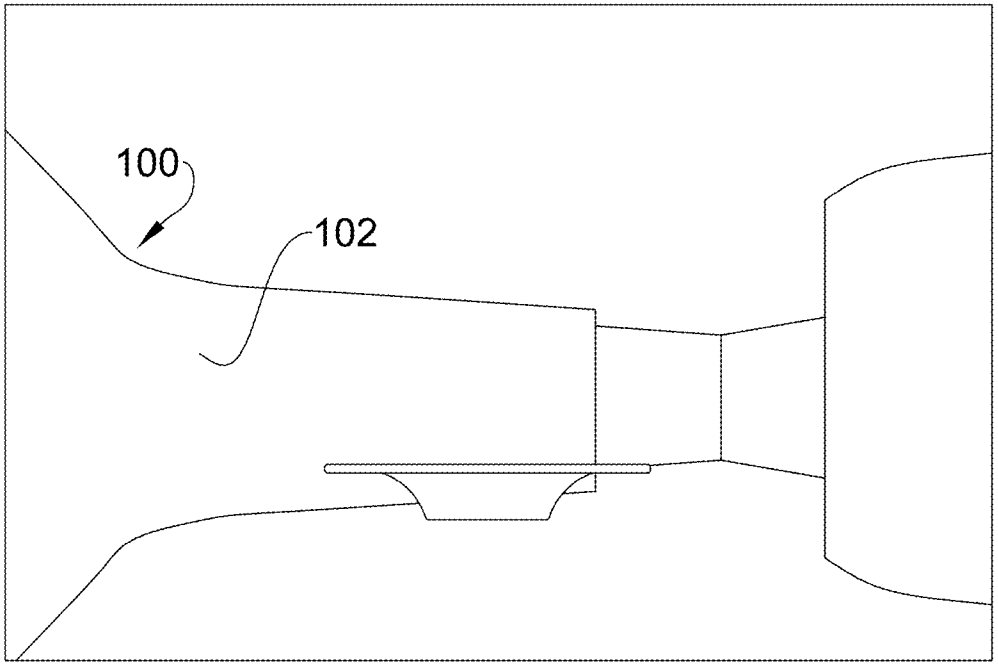
FIG. 1 depicts a commercial business workspace incorporating curvilinear architectural design elements such as in portions of the walls and ceilings in accordance with exemplary embodiments of this invention.

FIG. 1 depicts a commercial business workspace incorporating curvilinear architectural design elements into the walls, ceiling, and furnishings. The concave curvilinear wall portion 100 has an exposed outer wall covering 102 attached to the underlying structural framework. The wall covering 102 covers up the electrical and plumbing utilities that are routed through the hollow spaces between the wall coverings on opposing sides of the wall portion 100.

FIG. 2 is an enlarged portion of FIG. 1 showing the concave wall portion 100 but without any wall covering 102 on either side, thus depicting the underlying structural framework (or "framing structure") 104. The framing structure 104 for this curvilinear wall portion 100 has a top runner 106 and a bottom runner 108. The runners 106, 108 support respective opposing ends of each of a plurality of upright studs 110. To frame a wall curvature such as depicted in FIG. 2, the runners 106, 108 in these exemplary embodiments are constructed of a plurality of sections that are pivotally joined together.

FIG. 3 is an enlarged view of the top runner 106 in FIG. 2, focusing on just two adjacent sections $\mathbf{112}_1$, $\mathbf{112}_2$ in the top runner 106. As seen below, the sections 112 are identical, so the following disclosure pertaining to joining these two adjacent sections $\mathbf{112}_1$, $\mathbf{112}_2$ likewise pertains to joining other sections 112 together to form the top runner 106.

This enlarged perspective depicts exemplary embodiments in which each adjacent section $\mathbf{112}_1$, $\mathbf{112}_2$ has a respective planar base $\mathbf{113}_1$, $\mathbf{113}_2$. The bases 113 have overlapping portions that are pivotally joined together. The exploded perspective of FIG. 4 better depicts the sections 112 are identical in these exemplary embodiments. Here, each base 113 forms an eyelet 116 at one end and an eyelet opening 114 at the other end. These features are configured to join the adjacent sections $\mathbf{112}_1$, $\mathbf{112}_2$ together so that each can pivot at its joined end around a common axis of rotation 118.

This is achieved in these illustrative embodiments by inserting the first section's eyelet $\mathbf{116}_1$ into the second section's eyelet opening $\mathbf{114}_2$. The eyelet $\mathbf{116}_1$ can then be distorted by a manufacturing process to join the sections $\mathbf{112}_1$, $\mathbf{112}_2$ together in a close mating pivotal relationship, such as by expanding, crimping, or otherwise upsetting the eyelet $\mathbf{116}_1$ inside the eyelet opening $\mathbf{114}_2$. FIGS. 5*a* and 5*b* depict side and bottom views of the adjacent sections $\mathbf{112}_1$, $\mathbf{112}_2$ so joined, and pivoted slightly around their joined ends to achieve a curvilinear longitudinal shape.

Figure 4:
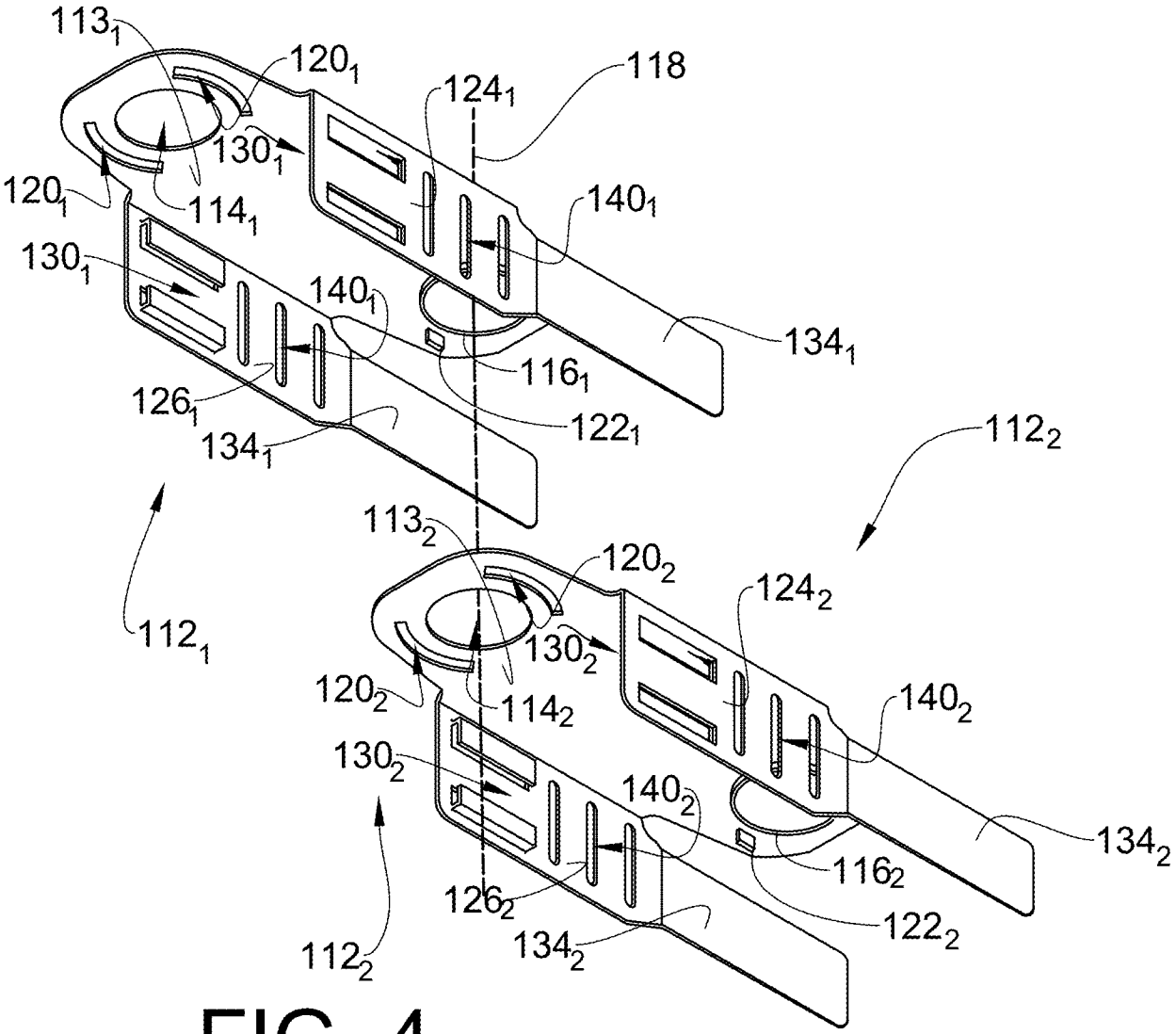
FIG. 4 depicts an exploded isometric view of the adjacent sections in FIG. 3, consistent with illustrative embodiments.

The exemplary top runner 106 is constructed by joining more sections 112 in the same way depicted in FIGS. 3-5. The pivotal sections 112 are cooperatively configurable to fashion a structural framework for constructing a curvilinear wall of virtually any desired shape.

These exemplary embodiments also depict other features for affixing the adjacent sections $\mathbf{112}_1$, $\mathbf{112}_2$ together after individually repositioning them all into the desired curvilinear wall shape. To that end, each section's base 113 also forms slots 120 curving around the eyelet opening 114. Further to that end, protuberant tabs 122 extend away from the planar base 113 around the eyelet 116. These features are configured such that the pivotable joinder of the adjacent sections $\mathbf{112}_1$, $\mathbf{112}_2$ discussed above with reference to FIGS. 3-5 also positions each protuberant tab 122 of one section 112 inside a respective mating slot 120 of the adjacent section 112. Namely, as best depicted in FIG. 4, the joinder of adjacent sections $\mathbf{112}_1$, $\mathbf{112}_2$ includes inserting the tabs $\mathbf{122}_1$ extending downwardly from the first section's base $\mathbf{113}_1$ into the slots $\mathbf{120}_2$ of the second section $\mathbf{112}_2$.

These features are configured so that pivotal repositioning of the adjacent sections $\mathbf{112}_1$, $\mathbf{112}_2$ causes each tab $\mathbf{122}_1$ to traverse the respective slot $\mathbf{120}_2$. This is best shown in FIG. 5 which depicts how pivoting the adjacent sections $\mathbf{112}_1$, $\mathbf{112}_2$ has moved each of the tabs $\mathbf{122}_1$ nearer to one end of the respective slot $\mathbf{120}_2$. When the repositioning achieves the desired curvilinear shape, the adjacent sections $\mathbf{112}_1$, $\mathbf{112}_2$ can be affixed together to retain the curvilinear shape by distorting the first section's tabs $\mathbf{122}_1$ residing inside the slots $\mathbf{120}_2$, such as by downward hammer blows against the first section's tabs $\mathbf{122}_1$ to deform them against the second section's base $\mathbf{113}_2$, in and around the second section's slots $\mathbf{120}_2$, to frictionally impede any further pivotal movement between the adjacent sections $\mathbf{112}_1$, $\mathbf{112}_2$ where they are joined together.

Staying with FIGS. 3-5, the overlapping planar surfaces of the joined-together bases $\mathbf{113}_1$, $\mathbf{113}_2$ serve to operably cover and enclose the top ends of the studs 110 (FIG. 2) from above them. In these exemplary embodiments, a track 124 extends from each base 113, and the tracks 124 cooperatively form a continuous sidewall that likewise covers and encloses the top ends of the studs 110 from one lateral side. The base 113 together with the track 124 forms an enclosure of each stud's top end above and along one of the sidewalls. The illustrative embodiments further depict an opposing second track 126 likewise extending from each base 113 and cooperatively forming an opposing sidewall. In this example, each section 112 has opposing tracks 124, 126 cooperating with the base 113 to form a C-shaped enclosure of the top ends of the studs 110 from above and laterally from both sidewalls.

FIGS. 3 and 4 best depict features in this example for connecting the adjacent tracks $\mathbf{124}_1$, $\mathbf{124}_2$ together to fashion a continuous sidewall enclosure. The same features connect the opposing adjacent tracks $\mathbf{126}_1$, $\mathbf{126}_2$ together to form the other sidewall enclosure. Here each of the adjacent tracks $\mathbf{124}_1$, $\mathbf{124}_2$ supports a pair of facing top and bottom flanges 128 defining respective longitudinally-directed channels between the pair of facing flanges 128. This is best depicted by the opposing adjacent tracks $\mathbf{126}_1$, $\mathbf{126}_2$ and the unobstructed view of their respective pair of facing top and bottom flanges 132. Each pair of facing flanges defines a longitudinally-directed channel 130.

Each of the adjacent tracks $\mathbf{124}_1$, $\mathbf{124}_2$ further supports a longitudinally-directed protuberant strap $\mathbf{134}_1$, $\mathbf{134}_2$ in this example. These features are configured so that, as the adjacent sections 112 are being pivotally joined together as discussed above, the strap 134 extending from a selected section 112 is inserted into the longitudinal channel 130 of the adjacent section 112, to which the selected section 112 is pivotally joined. For instance, here the first section's strap $134_1$ extends into the second section's longitudinal-directed channel 130 between the facing flanges $128_2$, $128'_2$. Pivotally repositioning the adjacent sections causes the first section's strap $134_1$ to slidingly engage the second section's channel 130. When the repositioning achieves the desired curvilinear shape, that shape can be retained by inserting a fastener to affix the second section's track $124_2$ and the first section's strap $134_1$ together. A pilot opening $136_2$ can be provided in the second track $124_2$ to aid in inserting such a fastener to connect the adjacent tracks $124_1$, $124_2$ together to form a connected link in the continuous sidewall enclosure.

Finally, each of the adjacent sections $112_1$, $112_2$ further forms laterally directed slots 140, which are features for isolating the studs 110 from stresses translated to the top runner 106. FIG. 6 depicts an elevational side view of a stud 110 that terminates at a top end 142 that is enclosed from view inside the top runner 106. The medial portion of a fastener 144 clearingly passes through one of the lateral slots 140 to connect to the stud 110 inside the enclosure. In this example, the fastener 144 passes through the vertical center of the slot 140 to connect to the stud 110.

After initially connecting the fastener 144 to the stud 110, horizontal movement of the section 112 is constrained by the narrow width of the slot 140 in relation to the size of the fastener 144. However, these features are configured such that the section 112 has a limited freedom of vertical movement. Clearances are provided allowing the slot 140 to be moved upwardly and downwardly relative to the fastener 144 passing through a vertical center of the slot 140. Installing the fastener 144 in the vertical center of the slot 140 effectively equalizes the upward and downward ranges of allowable deflection. Downward deflections occur as the top half of the slot 140 moves past the fastener 144, whereas upward deflections occur as the bottom half of the slot 140 moves past the fastener 144. This arrangement is merely illustrative, however, and not limiting of the contemplated embodiments of this invention. In alternative embodiments, the correct procedure can include installing the fastener 144 somewhere other than through the vertical center of the slot 140. Such may be the case, for example, where the expected ranges of deflection might be greater in one vertical direction than in the opposite vertical direction.

A critical attribute of this assembly is that each and every stud 110 must not be made too long so as to interfere with the desired vertical deflections. Instead, a sufficient clearance gap must exist between the section's base 113 and the stud's top end 142 to allow for the full range of expected downward deflection of the top runner 106. At the time of installing the fastener 144 through the slot's 140 vertical center, the stud's top end 142 is spaced from the top runner's base 113 by a gap 150. FIG. 7 is similar FIG. 6, but depicting a subsequent time when this same portion of the top runner 106 is deflected downwardly to the maximum limit of downward deflection. That movement brought the top end of the slot 140 into close proximity to, or contact with, the fastener 144, indicating that the designed-in limit of downward deflection has been reached in these illustrative embodiments.

FIG. 7 depicts even at the point of maximum expected downward deflection of the top runner 106, a small clearance 152 still remains between it and the stud's top end 142. That means the stud 110 in this example conforms to the critical assembly attribute concerning the maximum allowable length of each stud 110. Particularly, this assembly attribute ensures sufficient clearance exists between the stud's top end 142 and the top runner 106 to accommodate vertical deflections throughout the entire range of expected deflections.

A stud of a non-conforming length disadvantageously risks defeating not just the vertical deflection capability of this invention, but further risks compounding damage to the underlying structural framework and to the exposed wall coverings. The top end 142 of a non-conforming stud directly opposes the top runner's 106 downward movement, presenting a positive stop against any further downward deflection. That positive stop further translates stresses from the top runner 106 directly into one or more of the upright studs 110, instead of isolating the studs 110 from the stresses throughout the full intended range of vertical deflection.

The example of FIG. 6 depicts it is impossible to visually determine that the stud 110 conforms to its maximum length requirement. The stud's top end 142, and the gap 150 between it and the top runner 106, are almost totally out of visual sight enclosed inside the top runner 106 between the planar base 113 and the opposing sidewall tracks 124, 126. The operable maximum stud length is calculable, depending on variables such as slot length, slot vertical position, fastener install vertical position, and the like. Here, because the fastener 144 originally passed through the slot's 140 vertical center to connect to the stud 110, the maximum expected downward range of vertical deflection is one-half (the top half) of the slot's 140 overall length. In other words, the expected range of downward deflection begins at the slot's 104 neutral position around the fastener 114 as depicted in FIG. 6, at installation of the fastener 144. The expected range of downward deflection ends as depicted in FIG. 7 where the top end of the slot 140 is in close proximity to, or contacts, the fastener 144. So in these circumstances, the stud's top end 142 must initially clear the top runner 106 by a distance that is about half of the slot's 140 overall length. Also in this example, the top of the slot 140 is positioned closer to the top enclosure than the half-length of the slot 140. Thus, the top end 142 of the conforming stud 110 inside the top runner 106 upper enclosure is viewable through the slots 140. But again, there is no visual indication whatsoever that the stud 110 in FIG. 6 is conforming because its length is not too great to fully accommodate vertical deflection in accordance with this invention.

FIG. 8*a* is like FIG. 6 with the addition of an indicia 156 that gives a quick, simple, and accurate visual indication as to whether the stud 110 currently being installed into the structural framework is conforming, lengthwise, in order to fully accommodate vertical deflection in accordance with embodiments of this invention. The indicia 156 in this example is a notoriously predominant horizontal marking indicating the maximum allowable length of each stud 110, and intersecting the slots 140. The indicia 156 can be machined or stamped into the tracks 124, 126 in this example, or alternatively the indicia 156 can be printed, painted, etched, and the like. Further indicia and/or written comments and instructions can accompany the indicia 156 for purposes of communicating work instructions for the stud length conformance determination of these illustrative embodiments.

As seen in FIG. 8*a*, small portions of the conforming stud's top end 142 are viewable through the slots 140. The indicia 156, juxtaposed with the stud's top end 142, presents a visual standard of comparison for quickly and accurately determining whether the next stud's 110 length is conforming or not before installing the fastener 144 to the stud 110. In this manner, the indicia 156 visually presents an objective comparison of each stud's actual length to a predetermined threshold maximum length. This empowers the users to quickly and accurately confirm the conformance of each stud's length without need of measuring tools or special knowledge, experience, or skills. The visual indication depicted in FIG. 8*a* is that the stud's top end 142 is actually shorter than the threshold indicia 156, meaning it conforms to the limitation on length and is thus fit for use in constructing the structural framework in accordance with illustrative embodiments of this invention.

FIG. 8*b* depicts alternative indicia 157, 159 likewise serving to present a visual standard of comparison for quickly and accurately determining whether the next stud's 110 length is conforming or not before installing the fastener 144 to the stud 110. In this manner, the indicia 157, 159 likewise visually presents an objective comparison of each stud's actual length to a predetermined threshold maximum length. The indicia 157, 159 are depicted as being laterally-directed viewport openings through which more of, or bigger portions of, the stud's top end 142 inside the upper enclosure are viewable from an external perspective of the upper enclosure. The indicia 157, 159 can be sized and arranged to cooperatively present the threshold comparison discussed above for purposes of making conformance determinations for each stud's 110 length. For example, without limitation, the viewport openings 157, 159 can be arranged in vertical alignment as depicted. The vertical positions and sizes of the viewport openings 157, 159 can be selected such that a conforming stud's top end 142 will only be visible through the bottom viewport 159 and not through the top viewport 157. In other words, if the stud's top end 142 is viewable through the top viewport 157 then the indicia indicates the stud's length is non-conforming. The non-conforming stud 11 must be reworked by cutting it shorter before using it.

FIG. 8*c* depicts yet another alternative indicia 161 likewise serving to present a visual standard of comparison for quickly and accurately determining whether the next stud's 110 length is conforming or not before installing the fastener 144 to the stud 110. In this manner, the indicia 161 likewise visually presents an objective comparison of each stud's actual length to a predetermined threshold maximum length. The indicia 161 is depicted as being another laterally-directed viewport opening through which more of, or bigger portions of, the stud inside the upper enclosure are viewable from an external perspective of the upper enclosure. The indicia 161 is alternatively sized and arranged, but likewise is useful in comparing the actual length of the next stud 110 being installed to a predetermined threshold length for making the conformance determinations for each stud's 110 length. For example, the indicia 161 can be sized and arranged such as depicted above a vertical slot 140. In this manner, a conforming stud 110 will be visible only through the slot 140, but it will not also be visible through the viewport 161. Again, if the stud 110 is viewable in the viewport 161 then the indicia indicates the stud's 110 length is non-conforming, such that the stud must be reworked to bring it into conformance before using it.

FIGS. 9*a* and 9*b* depict bottom and side views of like-constructed and pivotally joined together, only longer, adjacent sections $\mathbf{112'}_1$, $\mathbf{112'}_2$. These longer sections 112' are particularly advantageous when used in a structural framework for constructing walls having relatively larger-radius curvatures. The increased length also allows providing more vertical slots for attaching to the studs 110. This eases complications of installation by significantly increasing the number and locations of attachment points for the studs 110.

FIG. 10 depicts another pair of adjacent sections $\mathbf{112''}_1$, $\mathbf{112''}_2$ derived from modifying the longer sections 112' in FIG. 9. In this example the individual, integral protuberant straps $\mathbf{134}_1$, $\mathbf{134}_2$ are replaced by one discrete, continuous strap 134' passing through respective aligned pairs of the channels 130 between each pair of facing flanges 128, 128' supported by each of the tracks $\mathbf{124''}_1$, $\mathbf{124''}_2$ in this example. FIG. 11 depicts a modified version of FIG. 10, wherein a discrete deflection track member 160 defining the vertical deflection slots 140 is connected to each of the adjacent sections 112", such that the slots 140 are operatively disposed beneath the common sidewall strap 134' to the adjacent sections 112". The deflection track member 160 continuously spans more than just one of the sections 112" forming the top runner 106. In this example, it has attachment points aligning with the pilot openings 136 used to insert fasteners to connect the continuous strap 134' to each respective section's track 124".

Finally, FIG. 12 depicts an alternative deflection track member 160' that is individually connected to only one of the sections 112" forming the top runner 106. In this example, the deflection track member 160' can be inserted as depicted to be operably sandwiched between the track $\mathbf{124''}_2$ and the continuous strap 134'. The distal end of the deflection track member 160' can thereby be supported inside the top flange $\mathbf{128}_2$. The deflection track member 160' can define a clearance opening 168 operably aligned with the bottom flange $\mathbf{128'}_2$. That allows the fastener installed into the pilot $\mathbf{136}_2$ location to urge a planar key portion 107 into the space between the pair of facing flanges 128, thereby locking the key 107 between the facing flanges $\mathbf{128}_2$, $\mathbf{128'}_2$ to prevent rotation. The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed:

1. A structural framework configured for constructing a curvilinear wall, the structural framework having top and bottom runners supporting respective opposing ends of each of a plurality of upright studs, the top runner having a plurality of sections pivotally joined together and thereby configured to form a wall having a selected curvature, each section comprising:

a planar base; and a track extending from the base and forming therewith an enclosure configured to receivingly engage the top ends of the studs, the track supporting a flange defining a longitudinally-directed channel, a longitudinally-directed protuberant strap, and a laterally-directed slot configured for passing a fastener through to connect to one of the studs, wherein a pivotal connection of adjacent first and second sections of the plurality of sections slidingly engages the first section's protuberant strap in the second section's channel.

2. The structural framework of claim 1 wherein each section comprises an eyelet at one end and an eyelet opening at the other end, wherein the first section's eyelet is configured to be receivingly disposed in the second section's eyelet opening in a close mating pivotal relationship.

3. The structural framework of claim 2 wherein the base further defines a curved slot adjacent the eyelet opening.

4. The structural framework of claim 3 wherein the base further comprises a protuberant tab, configured so that the first section's protuberant tab is receivingly disposed in the second section's curved slot so that pivotal repositioning of the adjacent first and second sections moves the tab within the curved slot.

5. The structural framework of claim 1 wherein the track further defines an opening configured to pass a fastener through to connect to the first section's protuberant strap affixing it in the second section's channel.

6. The structural framework of claim 1 wherein the track further comprises an indicia configured to visually indicate an operative maximum length for each stud for accommodating vertical deflection of the top runner relative to the studs.

7. The structural framework of claim 6 wherein the indicia comprise a laterally-directed viewport opening configured to visually indicate a selected one of the stud's conformance to the operative maximum length from an external perspective of the enclosure.

8. The structural framework of claim 7 wherein each section comprises a second track opposing the track both cooperating with the base to form a C-shaped enclosure.

9. A structural framework for framing a curvilinear wall having top and bottom runners supporting respective opposing ends of each of a plurality of upright studs, the top runner having a plurality of sections pivotally joined together to form a selected curvature, each section comprising:

a planar base;

a track extending from the base and forming therewith an enclosure configured to receivingly engage each stud's top end, the track supporting a flange defining a longitudinally-directed channel and a laterally-directed slot configured for passing a fastener to connect the section to a selected one of the studs; and a strap passing through the longitudinally-directed channel, wherein a pivotal connection of adjacent first and second sections of the plurality of sections slidingly engages the flange along the strap.

10. The structural framework of claim 9 wherein the laterally-directed slot is operably disposed beneath the longitudinally-directed channel.

11. The structural framework of claim 10 further comprising a vertical deflection member attached to the track.

12. The structural framework of claim 11 wherein the track has opposing flanges defining the longitudinally-directed channel, and the vertical deflection member further comprises a key configured to be operably constrained between the flanges to prevent rotation.

13. The structural framework of claim 11 wherein the vertical deflection member longitudinally spans two or more sections of the plurality of sections.

14. A structure for framing a wall having top and bottom runners supporting respective opposing ends of each of a plurality of upright studs, the top runner comprising:

a planar base;

a track extending from the base and forming therewith an enclosure configured to operably capture top ends of the studs and compensate for vertical deflection, the track defining a laterally-directed slot configured for installing a fastener through to connect to one of the studs inside the enclosure, and defining an indicia extending parallel to the top ends of the studs in the enclosure, the indicia visually presenting a conformance-comparison of each stud's length to a predetermined threshold length, the threshold related to a predetermined operable clearance between the top ends of the studs in the enclosure and the base.

15. The structure of claim 14 wherein the indicia comprise a laterally-directed viewport opening configured to visually present each stud's conformance from an external perspective of the enclosure.

16. The structure of claim 15 wherein the viewport opening is disposed between the laterally-directed slot and an adjacent laterally-directed slot in the track.

17. The structure of claim 15 wherein the viewport opening is operably disposed above the laterally-directed slot in the track.

18. The structure of claim 15 wherein the viewport opening comprises two openings that are laterally aligned.

19. The structure of claim 14 wherein the indicia comprise a mark intersecting the laterally-directed slot.

20. The structure of claim 19 wherein the track defines a plurality of laterally-directed slots, and the mark intersects two or more of the plurality of laterally-directed slots.

* * * * *